US008020424B2

(12) United States Patent
Suzuki et al.

(10) Patent No.: US 8,020,424 B2
(45) Date of Patent: Sep. 20, 2011

(54) RING COMPRESSION DEVICE AND RING COMPRESSION METHOD

(75) Inventors: Hitoshi Suzuki, Kanagawa (JP); Takashi Ogino, Nagano (JP); Takashi Miura, Nagano (JP)

(73) Assignee: NHK Spring Co., Ltd., Yokohama-shi (JP)

( * ) Notice: Subject to any disclaimer, the term of this patent is extended or adjusted under 35 U.S.C. 154(b) by 555 days.

(21) Appl. No.: 10/561,539

(22) PCT Filed: Jun. 18, 2004

(86) PCT No.: PCT/JP2004/008933

§ 371 (c)(1),
(2), (4) Date: Feb. 28, 2007

(87) PCT Pub. No.: WO2004/113018

PCT Pub. Date: Dec. 29, 2004

(65) Prior Publication Data

US 2007/0205564 A1 Sep. 6, 2007

(30) Foreign Application Priority Data

Jun. 20, 2003 (JP) ..... 2003-177019

(51) Int. Cl.
*B21D 41/00* (2006.01)

(52) U.S. Cl. ..... 72/402; 72/399; 29/508

(58) Field of Classification Search ..... 72/120, 72/121, 402, 399, 76, 452.8, 452.9; 29/508, 29/515, 516; 425/392, 393, DIG. 5
See application file for complete search history.

(56) References Cited

U.S. PATENT DOCUMENTS

| | | | | |
|---|---|---|---|---|
| 444,175 | A * | 1/1891 | West | 72/402 |
| 565,257 | A * | 8/1896 | Boyd | 72/402 |
| 2,196,619 | A * | 4/1940 | Andresen | 72/399 |
| 4,434,645 | A * | 3/1984 | Svercl et al. | 72/402 |
| 4,578,982 | A | 4/1986 | Schröck | |
| 5,715,723 | A * | 2/1998 | Owens | 72/402 |
| 5,890,270 | A * | 4/1999 | Oetiker | 29/235 |
| 2007/0056346 | A1 * | 3/2007 | Spenser et al. | 72/402 |

FOREIGN PATENT DOCUMENTS

JP SHO45-7817 4/1970

(Continued)

OTHER PUBLICATIONS

European Search Report mailed Apr. 28, 2009, issued in EP 04 74 6402.

*Primary Examiner* — Edward Tolan
*Assistant Examiner* — Pradeep C Battula
(74) *Attorney, Agent, or Firm* — Edwards Angell Palmer & Dodge LLP

(57) ABSTRACT

A ring compression device including a non-rotatable substrate having a central axis. A plurality of longitudinal pressing members are arranged radially around the central axis in a plane. One end of each of the pressing members points toward the central axis. The pressing members can move toward or away from the central axis in the plane. A rotating body rotates around the central axis and parallel to the plane of the pressing members. A driving mechanism engages with the rotating body and the pressing members such that when the rotating body rotates all the pressing members move toward the central axis and apply force on a periphery of the ring.

8 Claims, 13 Drawing Sheets

FOREIGN PATENT DOCUMENTS

| | | |
|---|---|---|
| JP | SHO51-139427 | 5/1975 |
| JP | 51-109516 | 9/1976 |
| JP | 57-55495 | 11/1982 |
| JP | 60-113134 | 7/1985 |
| JP | 60-245897 | 12/1985 |
| JP | 3-238124 | 10/1991 |
| JP | 10-575 | 1/1998 |
| JP | 2002-504436 | 2/2002 |

* cited by examiner

RING COMPRESSION DEVICE AND RING COMPRESSION METHOD

BACKGROUND OF THE INVENTION

1. Field of the Invention

The present invention relates to a ring compression device and a ring compression method that applies force on the periphery of a ring to compress the ring and mount the ring on a mounting body located inside a bore of the ring.

2. Description of the Related Art

A ring compression device has been known in the art that is used to mount a ring onto a mounting body. The ring compression device applies force on the periphery of the ring to compress the ring and mount it onto the mounting body that is inserted inside the ring. In one conventional ring compression device, two slide members that are arranged symmetrical to each other are allowed to perform only circular movements inside an housing. Four segments that are symmetrical to each other are connected to non-concentric inner surfaces of each of the slide members. Each segment has a clamping surface that is equidistant from a center, and can move toward or away from center in the radial direction. When compressing a ring, a ring is placed inside the segments and the slide members are caused to mutually approach each other. As a result, the segments move toward the center and the radius of a circle formed by the clamping surface of each segment becomes smaller, so that force is applied on the periphery of the ring and the ring is compressed (Refer to, for instance, Japanese Patent Laid-Open Publication No. H10-575).

In another ring compression conventional device, two cams can be moved within corresponding slits by operating corresponding guide block. With movements of the two cams, two semicircular sections of a pressing machine separated from each other move in the circumferential direction, which moves the cams inside the slits. Moreover, with the movements of the cams, a press jaw is driven inward in the radial direction. A ring is placed inside the press jaw. The ring is uniformly pressed by, for example, a rubber bellow, and the bellow is fixed and jointed, for instance, to a drive shaft (Refer to, for instance, Japanese Patent Publication No. 2002-504436).

In the one conventional ring compression device, due to movement of two slide members toward each other, the segments move inward in the radial direction, and a ring placed in an inner side from the segments is compressed with a force. However, there can be an assembly error between the two slide members. When there is an assembly error, the segments do not move uniformly, and it can be difficult to apply a uniform force onto the ring.

In the another conventional ring compression device, there can be dimensional error or assembly error in any of the two semicircular sections. When there is dimensional error or assembly error, the press jaws do not move uniformly, and it can be difficult to apply uniform force to the compression ring.

Furthermore, before a ring is compressed, there are clearances between the segments or the press jaws and the ring, and between the ring and the mounting body. The clearance is required to insert the ring inside the segments or the press jaws and insert the mounting body in the ring. In each of the conventional devices, however, there is no mechanism that can hold and position the ring inside the segments or the press jaws so that the ring does not touch the segments or the press jaws, or hold and position the mounting body in the ring so that the mounting body does not touch the ring. As a result, a non-uniform force is applied to the ring, which may compress the ring in a manner that is not intended. Furthermore, a non-uniform force is applied at the center of the mounting body, which may causes the ring to fix in a manner that is not intended.

In the light of the above circumstances, an object of the present invention is to provide a ring compression device and a ring compression method that can apply a uniform force onto the ring and also facilitate positioning of the ring and the mounting body.

SUMMARY OF THE INVENTION

According to an aspect of the present invention, a ring compression device for applying force to a ring to fix the ring on a mounting body includes a plurality of pressing members radially provided with tips thereof pointed to a central axis of a substrate and allowing the tips to freely move back and forth in relation to the central axis on a prespecified plane; a rotating body rotatably provided on the substrate on the central axis extending along the plane; and a driven unit that makes the tip of each of the pressing members move toward the central axis along with rotation of the rotating body and applying force to the ring from the outside thereof with the tips of the pressing members, wherein the rotating body is integrally engaged with each of the pressing members.

With the above aspect, tips of the pressing members are integrally moved by the rotational body toward the central axis. Namely, a delivery system for delivering motions to the pressing members from the rotating body is one system, so that the pressing members uniformly move and apply a uniform force to the ring.

According to another aspect of the ring compression device, in an initial state, a tip of a specific pressing member is aligned to a reference circle of the central axis constituting an external periphery of the ring, and tips of the other pressing members are provided in a position deviating to the outer side of the reference circle; and the driven unit aligns, when making each of the pressing members move forward, the tips of all pressing members to the reference circle, thereby making the tips of all pressing members move together.

With the above aspect, when a ring inserted into a reference circle in the initial state of the device is deformed from a perfect circle, a tip of the pressing member at a position deviated to the outer side from the reference circle accommodates deformation of the ring for allowing for insertion of the ring. Furthermore, when the pressing members are moved forward, positions of tips of all pressing members are aligned to the reference circuit and then the tips of all the pressing members are moved integrally, so that deformation of the ring is corrected to a perfect circle based on the reference circle.

According to still another aspect of the present invention, the ring compression device further includes a hooking unit for hooking the ring, the hooking unit having a claw member abutting on an edge face on one side of the ring on the side of the substrate and also having a movable claw member abutting on an edge face on the other side of the ring on the tip side of the specific pressing member, wherein, in the initial state, a tip of a specific pressing member is aligned to a reference circle for the central axis constituting an external periphery of the ring, and tips of the other pressing members are provided in a position deviating to the outer side of the reference circle; and the driven unit aligns, when making the each of the pressing members move forward, the tips of all pressing members to the reference circle, thereby making the tips of all pressing members move together.

With the above aspect, when a ring inserted into a reference circle in the initial state of the device is deformed from a perfect circle, a tip of the pressing member at a position deviated to the outer side from the reference circuit accommodates deformation of the ring for allowing for insertion of the ring. Furthermore, when the pressing members are moved forward, positions of tips of all pressing members are aligned to the reference circuit and then the tips of all pressing members are moved integrally, so that deformation of the ring is corrected to a perfect circle based on the reference circle. In addition, the ring can accurately be held at the positions of tips of the pressing members. Even when the ring is deformed, a tip of the pressing member at a position deviated to the outer side from the reference circuit accommodates deformation of the ring, so that the ring can easily be inserted and hooked therein.

According to still another aspect of the present invention, the ring compression device further includes a holding unit for aligning and holding the mounting body in relation to the central axis.

With the above aspect, a mounting body is held on a central shaft of the substrate with the holding unit, so that the mounting body can easily be aligned for positioning to a position where the ring is to be fixed.

According to still another aspect of the present invention, the ring compression device further includes a holding unit for aligning and holding the mounting body in relation to the central axis, wherein, in an initial state, a tip of a specific pressing member is aligned to a reference circle for the central axis constituting an external periphery of the ring, and tips of the other pressing members are provided in a position deviating to the outside of the reference circle; and the driven unit aligns, when making the each of the pressing members move forward, the tips of all pressing members to the reference circle, thereby making the tips of all pressing members move together.

With the above aspect, when a ring inserted into a reference circle in the initial state of the device is deformed from a perfect circle, a tip of the pressing member at a position deviated to the outer side from the reference circuit accommodates deformation of the ring for allowing for insertion of the ring. Furthermore, when the pressing members are moved forward, positions of tips of all pressing members are aligned to the reference circuit and then the tips of all pressing members are moved integrally, so that deformation of the ring is corrected to a perfect circle based on the reference circle. In addition, the mounting body is held with the holding unit to a central shaft of the substrate, so that the mounting body can easily be positioned in relation to a position where the ring is to be fixed.

According to still another aspect of the present invention, the ring compression device further includes a hooking unit for hooking the ring, the hooking unit having a claw member abutting on an edge face on one side of the ring on the side of the substrate while having a movable claw member abutting on an edge face on the other side of the ring on the tip side of the specific pressing member; and a holding unit for aligning and holding the mounting body in relation to the central axis, wherein, in the initial state, a tip of a specific pressing member is aligned to a reference circle for the central axis constituting an external periphery of the ring, and tips of the other pressing members are provided in a position deviating to the outside of the reference circle; and the driven unit aligns, when making the each of the pressing members move forward, the tips of all pressing members to the reference circle, thereby making the tips of all pressing members move together.

With the above aspect, when a ring inserted into a reference circle in the initial state of the device is deformed from a perfect circle, a tip of the pressing member at a position deviated to the outer side from the reference circuit accommodates deformation of the ring for allowing for insertion of the ring. Furthermore, when the pressing members are moved forward, positions of tips of all pressing members are aligned to the reference circuit and then the tips of all pressing members are moved integrally, so that deformation of the ring is corrected to a perfect circle based on the reference circle. In addition, the ring can accurately be hooked at the positions of tips of the pressing members. Even when the ring is deformed, a tip of the pressing member at a position deviated to the outer side from the reference circuit accommodates deformation of the ring, so that the ring can easily be inserted and hooked therein. Furthermore, a mounting body is held on a central shaft of the substrate with the holding unit, so that the mounting body can easily be aligned for positioning to a position where the ring is to be fixed.

According to still another aspect of the present invention, a ring compression method is a method of fixing a ring onto a mounting body by applying force on the ring and includes hooking the ring in an inner position of each tip of the plurality of pressing members provided to freely move forward to a prespecified central axis; inserting the mounting body into the ring to align and hold the mounting body to the central axis; and applying force at the tip moved forward from the outside of the ring.

With the above aspect, before a ring is set to a mounting body, a clearance between the ring and the mounting body is accommodated, so that the ring and the mounting body can easily be positioned to each other. As a result, force to the ring is stabilized, and force to a center of the mounting body is stabilized, so that the ring can favorably be set to the mounting body.

According to still another aspect of the present invention, a ring compression method further includes aligning, before hooking the ring, a tip of a specific pressing member to a reference circle for the central axis constituting external periphery of the ring, and providing the tips of the other pressing members in a position deviating to the outside of the reference circle; and aligning, when each of the tips are moved forward, the tips of all pressing members to the reference circle.

With the above aspect, before a ring is hooked, when the ring to be inserted into a reference circle is deformed from a perfect circle, a tip of the pressing member at a position deviated to the outer side from the reference circle accommodate deformation of the ring, so that insertion of the ring is possible. Furthermore, when the tips are moved forward, positions of all the tips are aligned to the reference circle, so that deformation of the ring is corrected to a perfect circle based on the reference circle.

DETAILED DESCRIPTION OF AN EXEMPLARY ENVIRONMENT

The present invention is explained in more detail with reference to the accompanying drawings.

Figure 1:
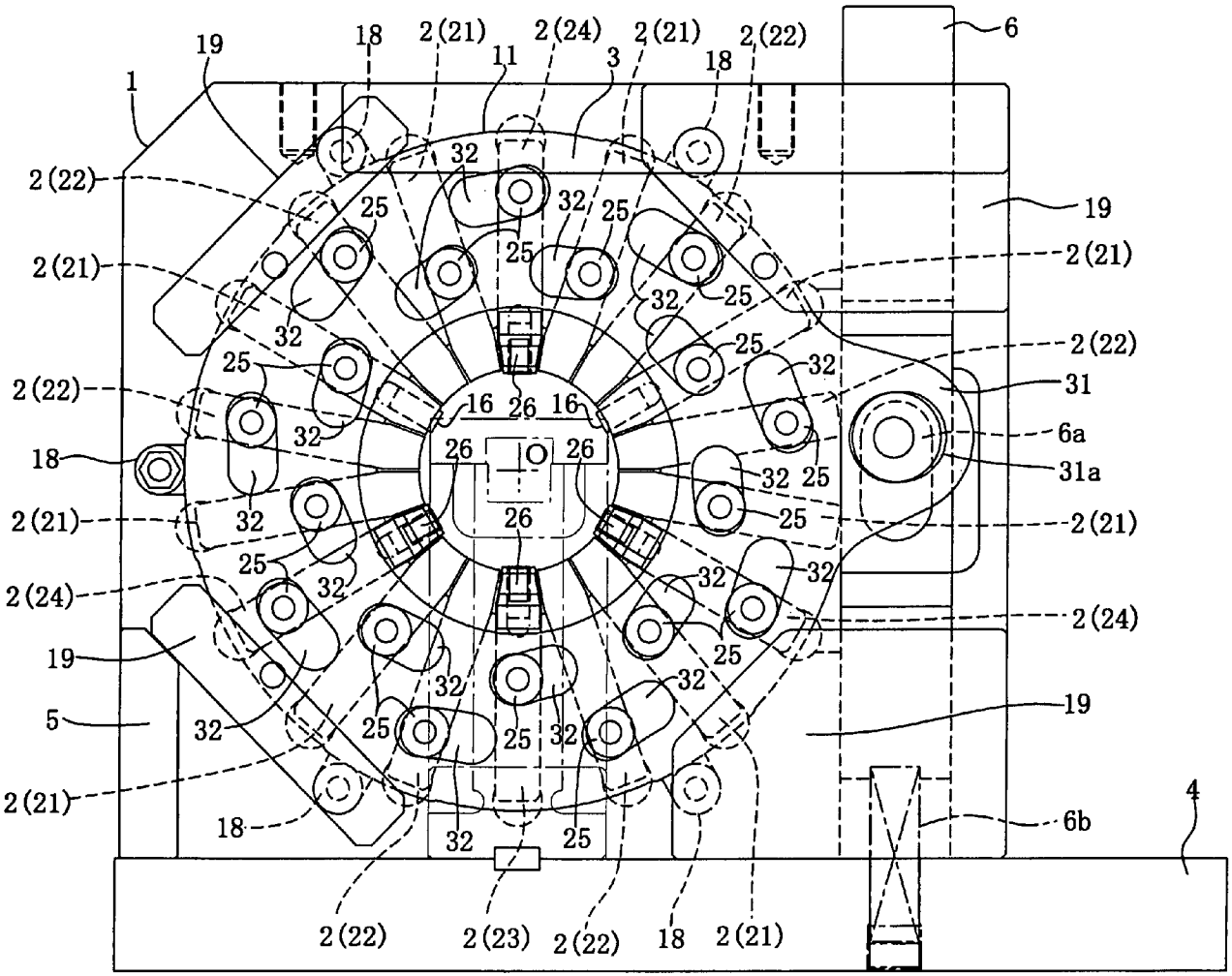
FIG. 1 is a front view of a ring compression device according to an embodiment of the present invention.
Figure 2:
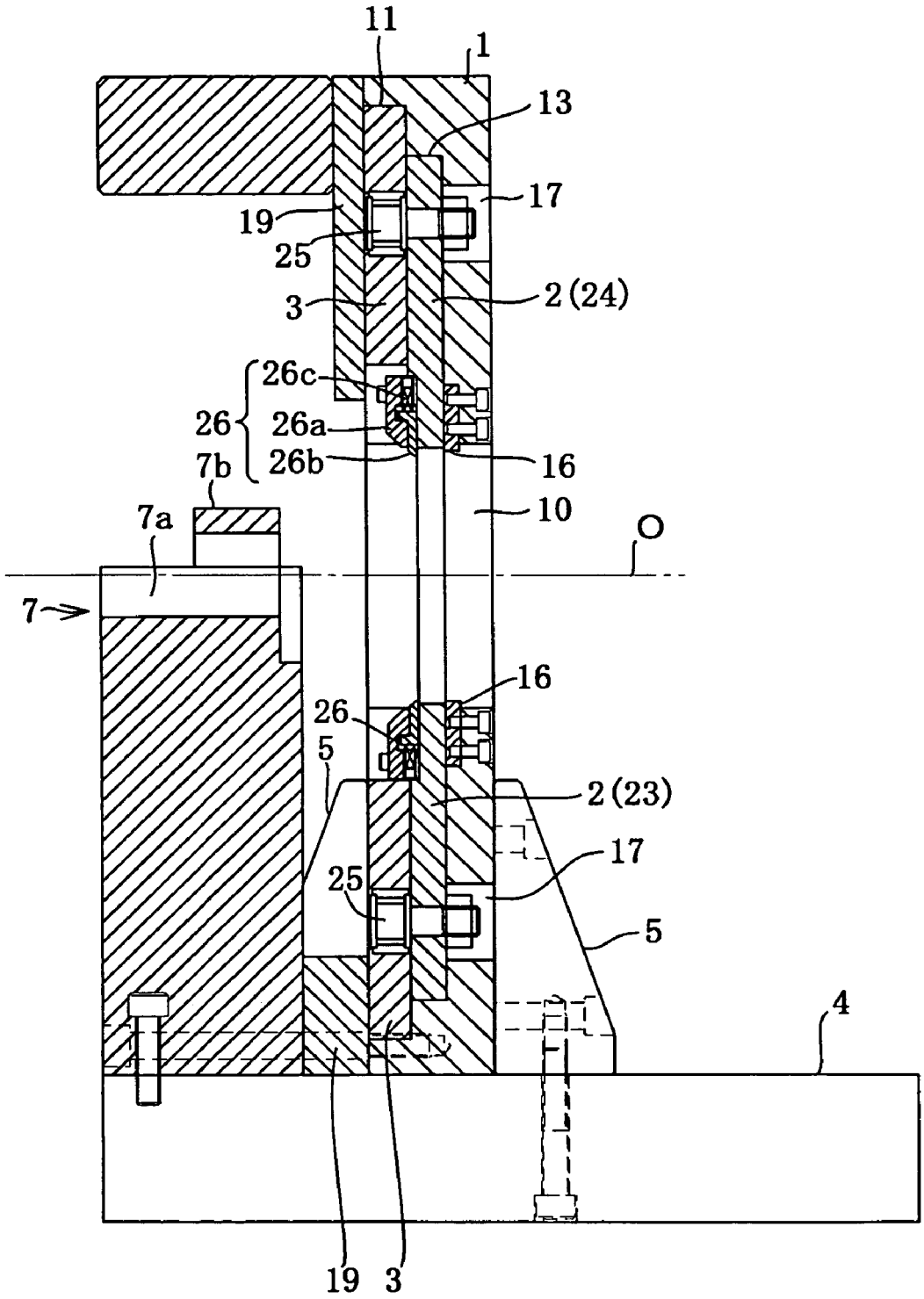
FIG. 2 is a side cross-sectional view of the ring compression device.
Figure 3:
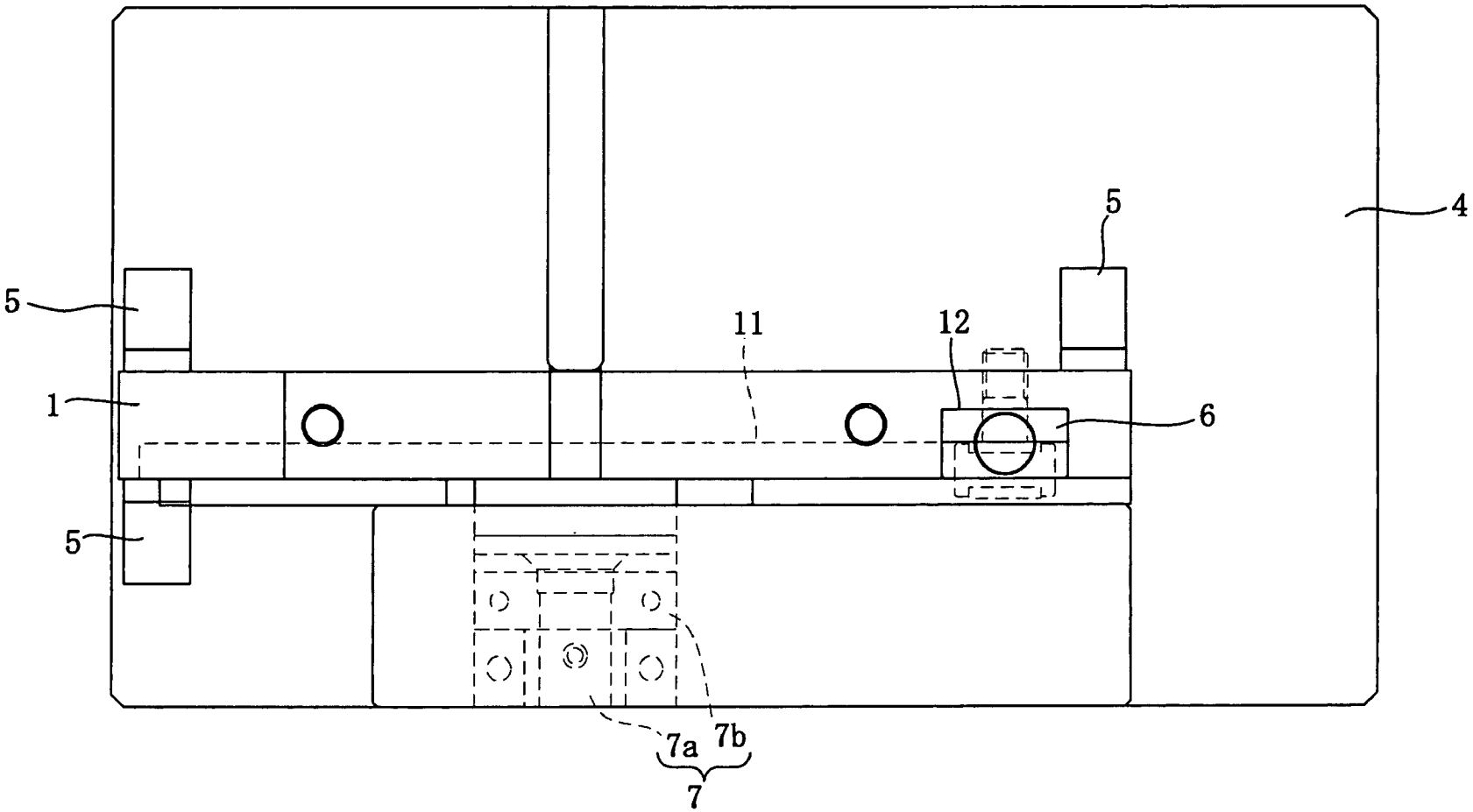
FIG. 3 is a side view of the ring compression device.
Figure 4:
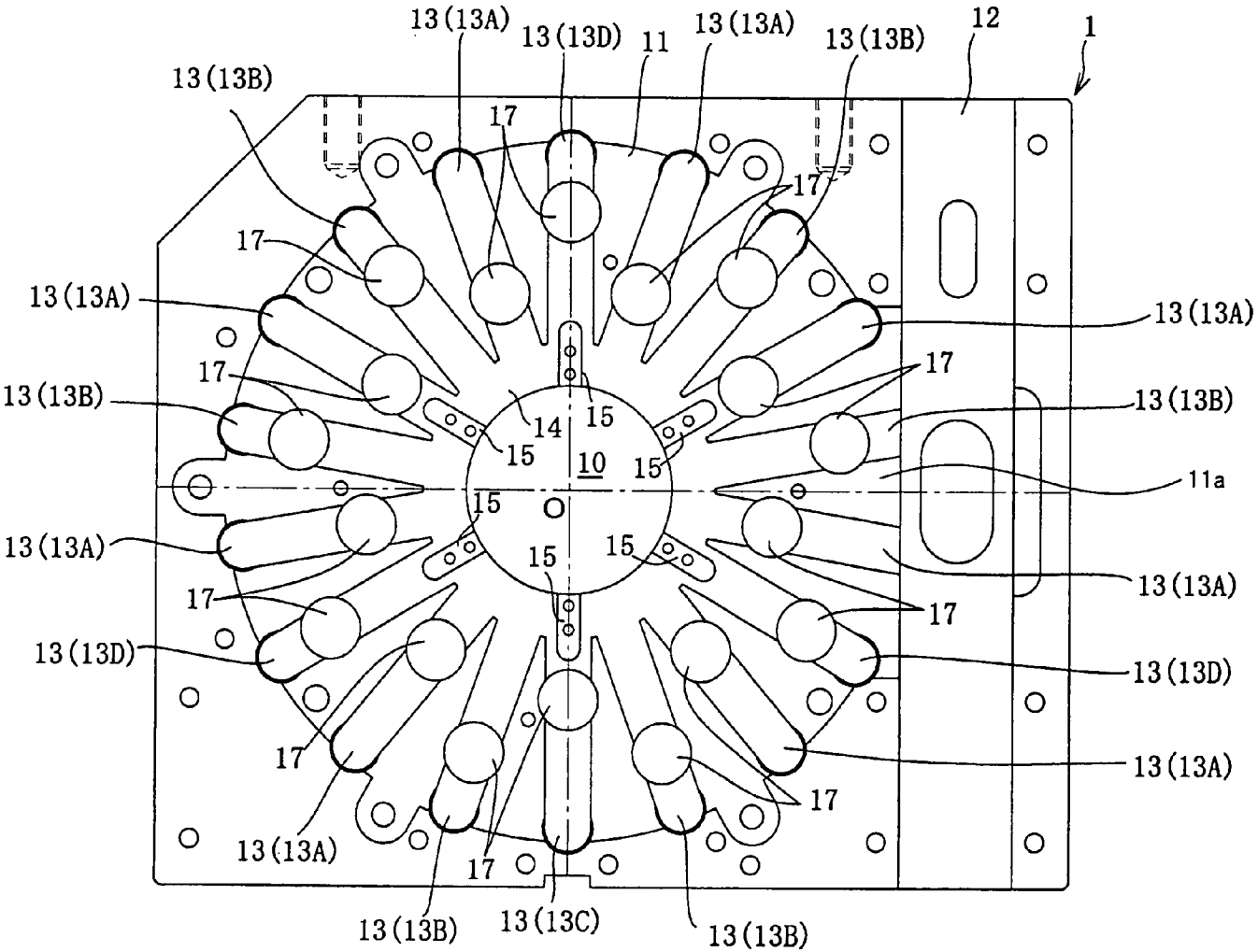
FIG. 4 is a front view of a substrate of the ring compression device.
Figures 5A, 5B, 5C, 5D:
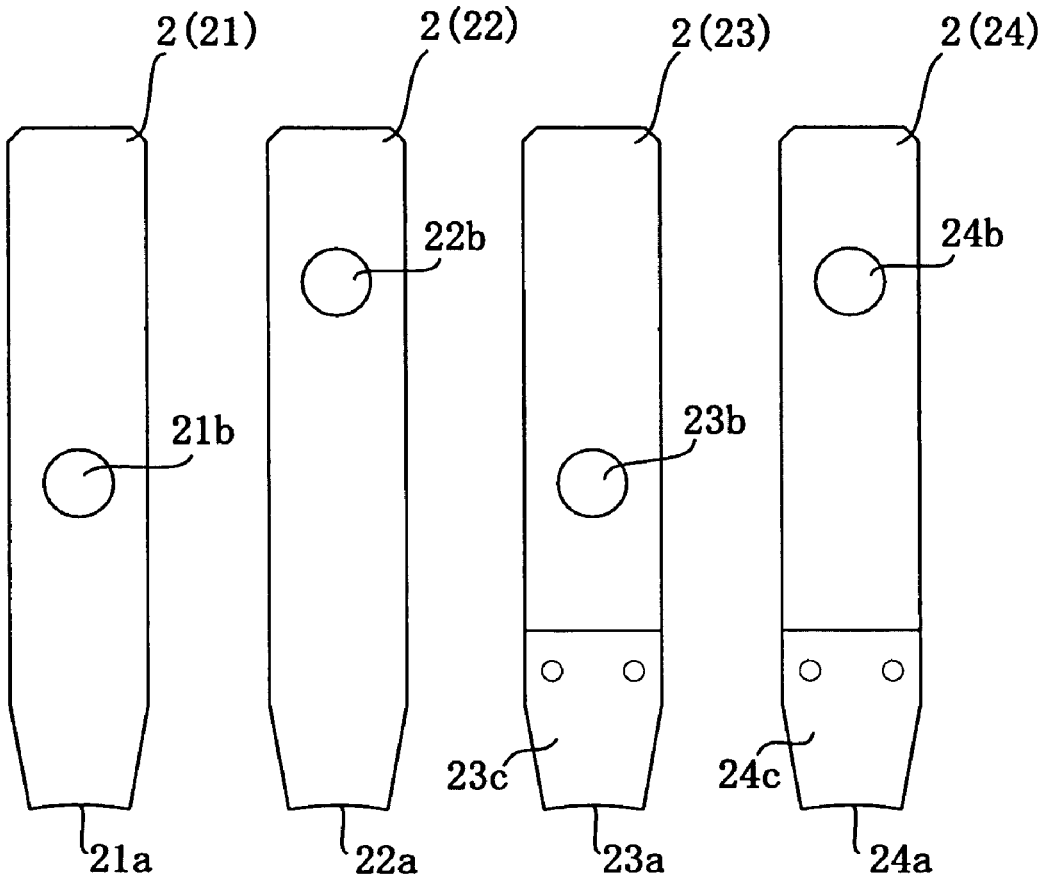
FIG. 5A to FIG. 5D are front views of pressing members used in the ring compression device.
Figure 6:
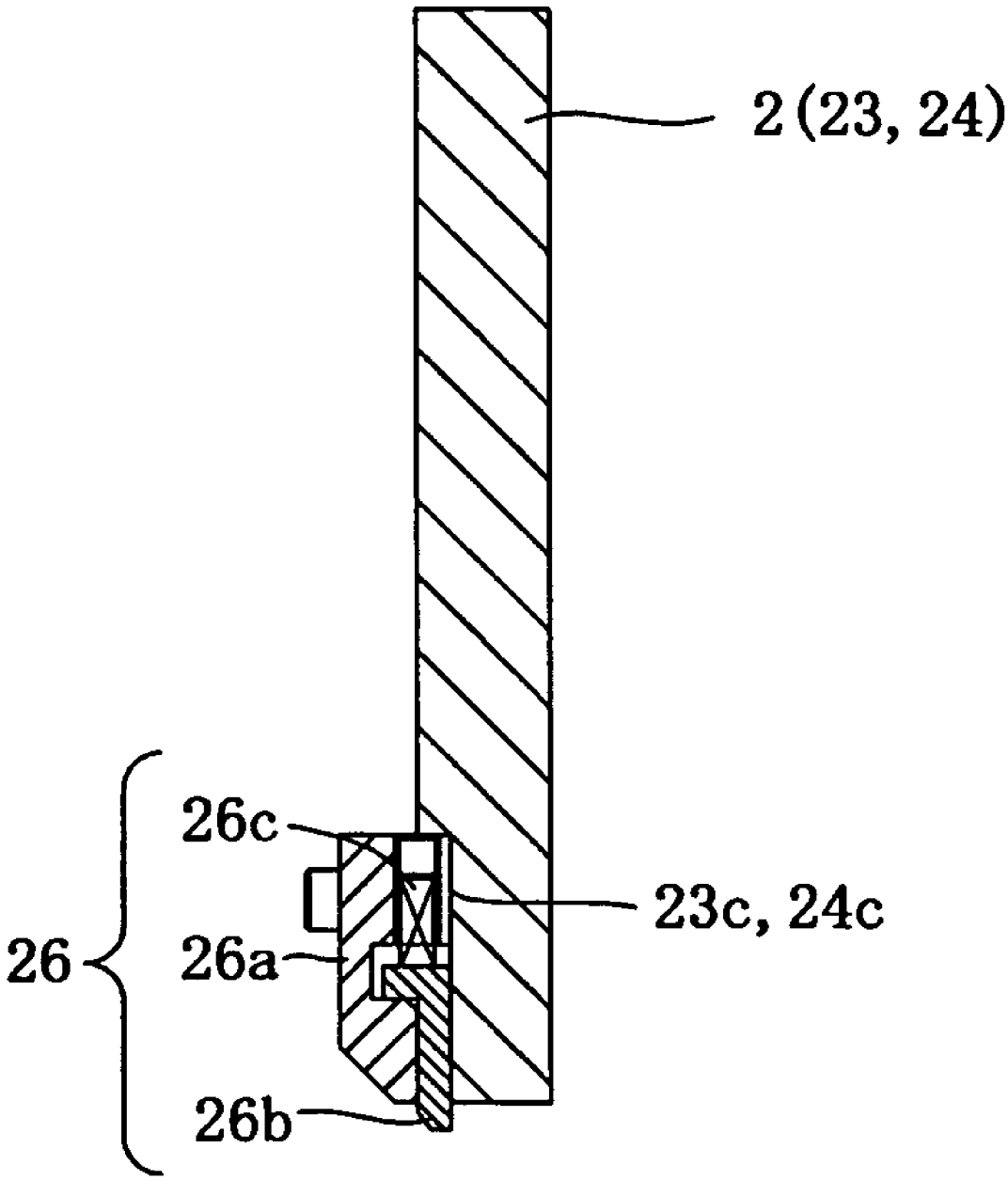
FIG. 6 is a side view of a movable claw section.
Figure 7:
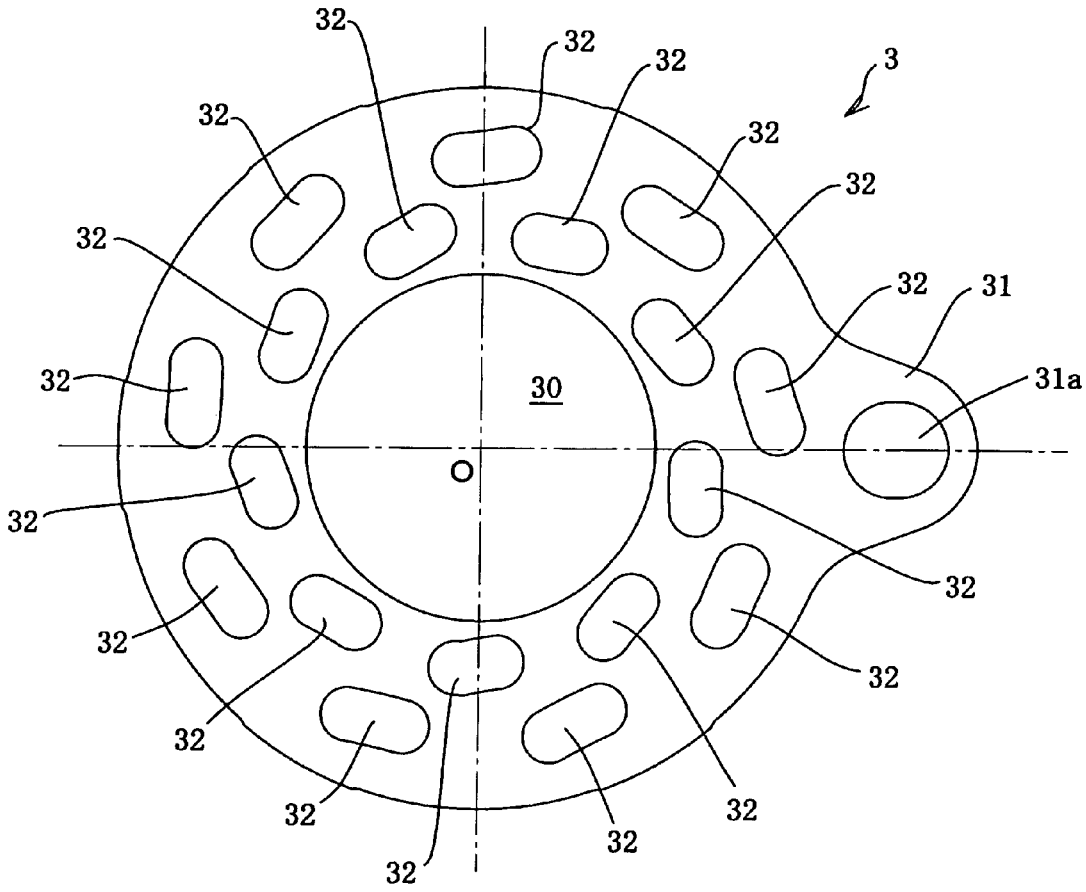
FIG. 7 is a front view of a rotational body of the ring compression device.

FIG. 1 is a front view of a ring compression device according to an embodiment of the present invention; FIG. 2 is a side cross-sectional view of the ring compression device; FIG. 3 is a side view of the ring compression device; FIG. 4 is a front view of a substrate of the ring compression device; FIG. 5A to FIG. 5D are front views of pressing members used in the ring compression device; FIG. 6 is a side view of a movable claw section; and FIG. 7 is a front view of a rotational body of the ring compression device.

The ring compression device according to the present embodiment is used for mounting a ring R onto a mounting body D placed in the ring R. The ring R is mounted by applying force onto the periphery of the ring R thereby compressing, the ring. The ring R is prepared by forming a sheet plate body made of metal material such as an aluminum alloy or a stainless steel alloy to a endless loop form. The mounting body D includes, for example, a constant velocity joint shown in FIG. 10. Constant velocity joints are used in vehicles. The constant velocity joint has the configuration in which a shaft D1 is integrated with a cup-shaped joint D2 and another shaft D3 is connected to the shaft D1 inside of the joint D2. A bellow-like cylindrical boot D4 covers an external periphery of the joint D2 and some portion of the shaft D3 to prevent grease filled in the joint D2 from leaking. The ring R is mounted on one end of the boot D4 so that the one end is clamped tightly onto the periphery of the joint D2.

As shown in FIG. 1 to FIG. 3, the ring compression device includes a substrate 1, a pressing member 2, and a rotational body 3 as main components. A rib 5 is fixed on a base plate 4. The rib 5 firmly holds the substrate 1. The pressing member 2 and the rotational body 3 are provided on the substrate 1.

As shown in FIG. 4, the substrate 1 has a central axis O extending along the thickness of the substrate 1. The substrate 1 has a circular insertion hole 10 around the central axis O and the insertion hole 10 extends from a front surface to a rear surface of the substrate 1. Furthermore, a circular accommodating concave section 11 is provided in the front side of the substrate 1 around the central axis O. The accommodating concave section 11 is larger in diameter than the insertion hole 10. Namely, the insertion hole 10 is located inside the accommodating concave section 11. A concave groove 12 that extends in the vertical direction is provided in the side section of the substrate 1 in the front side (right side in FIG. 4). A side section of the accommodating concave section 11 (right side in FIG. 4) communicates to the concave groove 12 via a communicating concave section 11*a* having the same depth as that of the accommodating concave section 11.

Bottom sections of the accommodating concave section 11 and the communicating concave section 11*a* are flat. Guide grooves 13 (13A, 13B, 13C, 13D) are provided on the bottom sections. The guide grooves 13 extend longitudinally in the radial direction from the central axis O, and in this embodiment, 18 equally-spaced grooves are provided around the central axis O. The bottom sections of each guide groove 13 is on the same plane. Furthermore, the guide grooves 13 merge with each other before the grooves reach the insertion hole 10, so that a continuous circular groove 14 is formed around the insertion hole 10.

Fixed concave sections 15 are provided in the circular groove 14. Each fixed concave section 15 extends into a corresponding guide groove 13 (the fixed concave section 15 extend into six equally-spaced guide grooves 13 starting from the guide groove 13 at the top in this embodiment). The fixed concave sections 15 extend radially from the central axis O. The fixed concave sections 15 have smaller widths than those of the guide grooves 13, and they extend up to the insertion hole 10. Claw members 16 each as a hooking unit are fixed in the fixed concave sections 15 (as shown in FIG. 2). The claw members 16 are accommodated within the fixed concave sections 15 and their edge sections extend inside the periphery of the insertion hole 10.

Escape holes 17 are formed in the substrate 1 in the guide grooves 13. The escape holes 17 are provided at different distances from the central axis O in the adjoining guide grooves 13. In this embodiment, the escape hole 17 in the guide groove 13 in the top is located away from the central axis O. The escape hole 17 in the guide groove 13 adjoining that in the top is located close to the central axis O. As described above, the escape holes 17 are provided in adjoining guide grooves 13 at positions far from the adjacent guide groove 13 and at positions close to the central axis O alternately.

Each of the pressing members 2 is inserted into each of the guide grooves 13. As shown in FIG. 5A to FIG. 5D, the pressing member 2 can have four different structures. As shown in FIG. 5A, a first pressing member 21 has a slender form with the cross-sectional form having such a width and a thickness that the first pressing member 21 can freely move in the corresponding guide groove 13 (13A) along the longitudinal direction. An edge face of a tip 21*a* of the first pressing member 21 that faces toward the central axis O of the substrate 1 when inserted into the guide groove 13 is arc-shaped. Furthermore, a fixing hole 21*b* is formed in the first pressing member 21. A cam follower 25 (Refer to FIG. 1 and FIG. 2) as a driven unit for engaging in the rotational body 3 is inserted in the fixing hole 21*b*.

As shown in FIG. 5B, a second pressing member 22 has a slender form and also has a cross-sectional form with such a width and a thickness that allows free movement in the corresponding guide groove 13 (13B) in the longitudinal direction. An edge face of a tip 22*a* of the second pressing member 22 that faces toward the central axis O of the substrate 1 is arc-shaped. Furthermore, a fixing hole 22*b* is formed in the second pressing member 22. A cam follower 25 (Refer to FIG. 1 and FIG. 2) as a driven unit for engaging in the rotational body 3 is inserted in the fixing hole 22*b*.

As shown in FIG. 5C, a third pressing member 23 has a slender form and also has a cross-sectional form with such a width and a thickness that allows free movement in the corresponding guide groove 13 (13C) in the longitudinal direction. An edge face of a tip 23*a* of the third pressing member 23 that faces toward the central axis O of the substrate 1 is arc-shaped. Furthermore, a fixing hole 23*b* is formed in the third pressing member 23. A cam follower 25 (Refer to FIG. 1 and FIG. 2), as a driving unit, that engages in the rotational body 3 is inserted in the fixing hole 23*b*. Moreover, a step section 23*c* having a smaller thickness than the other portion of the third pressing member 23 is formed in a section near the tip 23*a*.

As shown in FIG. 5D, a fourth pressing member 24 has a slender form and also has a cross-sectional form with such a width and a thickness that allows free movement in the corresponding guide groove 13 (13D) in the longitudinal direction. An edge face of a tip 24*a* of the fourth pressing member 24 that faces toward the central axis O of the substrate 1 is arc-shaped. Furthermore, a fixing hole 24*b* is formed in the fourth pressing member 24. A cam follower 25 (Refer to FIG. 1 and FIG. 2), as a driving unit, that engages in the rotational body 3 is inserted in the fixing hole 24*b*. Moreover, a step section 24*c* having a smaller thickness than the other portion of the fourth pressing member 24 is formed in a section near the tip 24*a*.

The first pressing member 21 and the second pressing member 22 have the same configuration with a difference in the positions of the fixing holes 21*b* and 22*b*. In the first pressing member 21 the fixing hole 21*b* is closer to the tip 21*a*, while in the second pressing member 22 the fixing hole 22*b* is closer to the base end. The third pressing member 23 and the fourth pressing member 24 have the same configuration, with a difference in the positions of the fixing holes 23*b* and 24*b*. In the third pressing member 23 the fixing hole 23*b* is closer to the tip 23*a*, and in the fourth pressing member 24 the fixing hole 24*b* is closer to the base end. Positions of the fixing holes 21*b*, 22*b*, 23*b*, and 24*b* relate to the rotational body 3.

Movable claw sections 26 each as a holing unit are provided at the tips 23*a*, 24*a* of the third pressing member 23 and the fourth pressing member 24. As shown in FIG. 6, the movable claw sections 26 are provided in the step sections 23*c* and 24*c* of the third pressing member 23 and the fourth pressing member 24. Each of the movable claw sections 26 has a fixing section 26*a* and a movable section 26*b*. The fixing sections 26*a* are fixed to the step sections 23*c* and 24*c*, and the movable sections 26*b* are movably supported on the tips 23*a* and 24*a*. Furthermore, a compression spring 26*c* is provided between the fixing section 26*a* and the movable section 26*b*. The movable sections 26*b* are pushed by the compression spring 26*c* toward the tips 23*a*, 24*a*, and are supported by the fixing sections 26*a* in the state where the movable sections 26*b* extend each by a prespecified length from the tips 23*a*, 24*a*. Furthermore, edge faces of the fixing section 26*a* and the movable section 26*b* facing against the tips 23*a*, 24*a* respectively are machined to tapered faces 26*d*.

As shown in FIG. 7, the rotational body 3 is plate-like having a circular external periphery with the central axis O at the center. The external shape of the rotational body 3 allows for insertion thereof into the accommodating concave section 11 provided in the substrate 1. Furthermore, the rotational body 3 has a circular insertion hole 30 around the central axis O. The insertion hole 30 has a larger diameter than that of the insertion hole 10 provided in the substrate 1. The rotational body 3 has an arm section 31 that extends in one direction (right direction in FIG. 7). The arm section 31 has a cam hole 31*a*. Furthermore, the rotational body 3 has a cam holes 32. Each cam hole 32 as a driven unit engages in each cam follower 25 of each pressing member 2. The cam holes 32 are provided at 18 positions corresponding to the pressing members 2 (21, 22, 23, 24) inserted into the guide grooves 13 (13A, 13B, 13C, and 13D) on the substrate 1.

With such a configuration, as shown in FIG. 1 and FIG. 2, the pressing members 2 are inserted into the guide grooves 13 on the substrate 1. The first pressing members 21 are inserted into the guide grooves 13A provided at eight positions as shown in FIG. 4. The second pressing members 22 are inserted into the guide grooves 13B provided at six positions as shown in FIG. 4. The third pressing member 23 is inserted into the guide groove 13C provided at one position as shown in FIG. 4. The fourth pressing members 24 are inserted into the guide grooves 13D provided at three positions as shown in FIG. 4.

The accommodating concave section 11 provided in the substrate 1 accommodates therein the rotational body 3 as shown in FIG. 1 and FIG. 2. The rotational body 3 accommodated within the accommodating concave section 11 supports the pressing members 2 inserted into the guide grooves 13 from the front side. Furthermore, the cam followers 25 set on the pressing members 2 are inserted into the cam holes 32 on the rotational body 3. A plurality of support rollers 18 (provided at 5 positions shown in FIG. 1 in this embodiment) are provided along an external periphery of the accommodating concave section 11. These support rollers 18 align the rotational body 3 along the central axis O of the substrate 1 and also support the rotational body 3 so that the rotational body 3 can rotate within the accommodating concave section 11. Furthermore, pressing section 19 are provided in the substrate 1 for supporting the rotational body 3 accommodated within the accommodating concave section 11 from the front side. When the cam holes 32 are engaged with the cam followers 25, the rotational body 3 integrally engages with the pressing members 2 and can rotate around the central axis O.

The fixing holes 21*b*, 22*b*, 23*b*, and 24*b* in the pressing members 2 are provided at positions that allow for engagement with the cam followers 25 and the cam holes 32 provided in the rotational body 3. The escape holes 17 in the guide grooves 13 are provided at positions that allow for insertions of screw sections 25*a* (shown in FIG. 2) for setting the cam follower 25 on the pressing members 2 and also to prevent contact of the screw sections 25*a* with the substrate 1.

A push rod 6 is inserted into the concave grove 12 on the substrate 1. The push rod 6 can move in the vertical direction along the concave groove 12. A cam follower 6*a* is set in the substantially intermediate section of the push rod 6. The cam follower 6*a* is inserted into and engaged with a cam hole 31*a* provided in the arm section 31 of the rotational body 3. Furthermore, a compression spring 6*b* is provided between a lower edge of the push rod 6 and the base plate 4. The compression spring 6*b* pushes the push rod 6 upward (as shown in FIG. 1). An upper edge of the push rod 6 thrusts out from the upper side of the substrate 1.

With such a configuration, when the push rod 6 moves in the vertical direction, the arm section 31 moves in the vertical direction via engagement between the cam follower 6*a* and the cam hole 31*a*, so that the rotational body 3 rotates around the central axis O in the direction as indicated by an arrow A in FIG. 1. Furthermore, when the rotational body 3 rotates, the pressing members 2 (21, 22, 23, 24) move along the guide grooves 13 on the substrate 1 via engagement between the cam hole 32 and the cam follower 25, so that the tips 21*a*, 22*a*, 23*a*, and 24*a* move back and forth against the central axis O.

A holding unit 7 is provided on the base plate 4. The holding unit 7 holds and positions a mounting body against the central shaft O. The holding unit 7 according to the present embodiment aligns a central axis line of the constant velocity joint as a mounting body with the central axis O. For the alignment, the holding unit 7 has an engagement groove 7*a* for engagement with a portion of a joint section of the constant velocity joint and a holding section 7*b* holding the joint section engaged in the engagement groove 7*a* with the engagement groove 7*a* and overriding the engagement groove 7*a* for fixing.

Actions of the ring compression device are described below.

Figure 8:
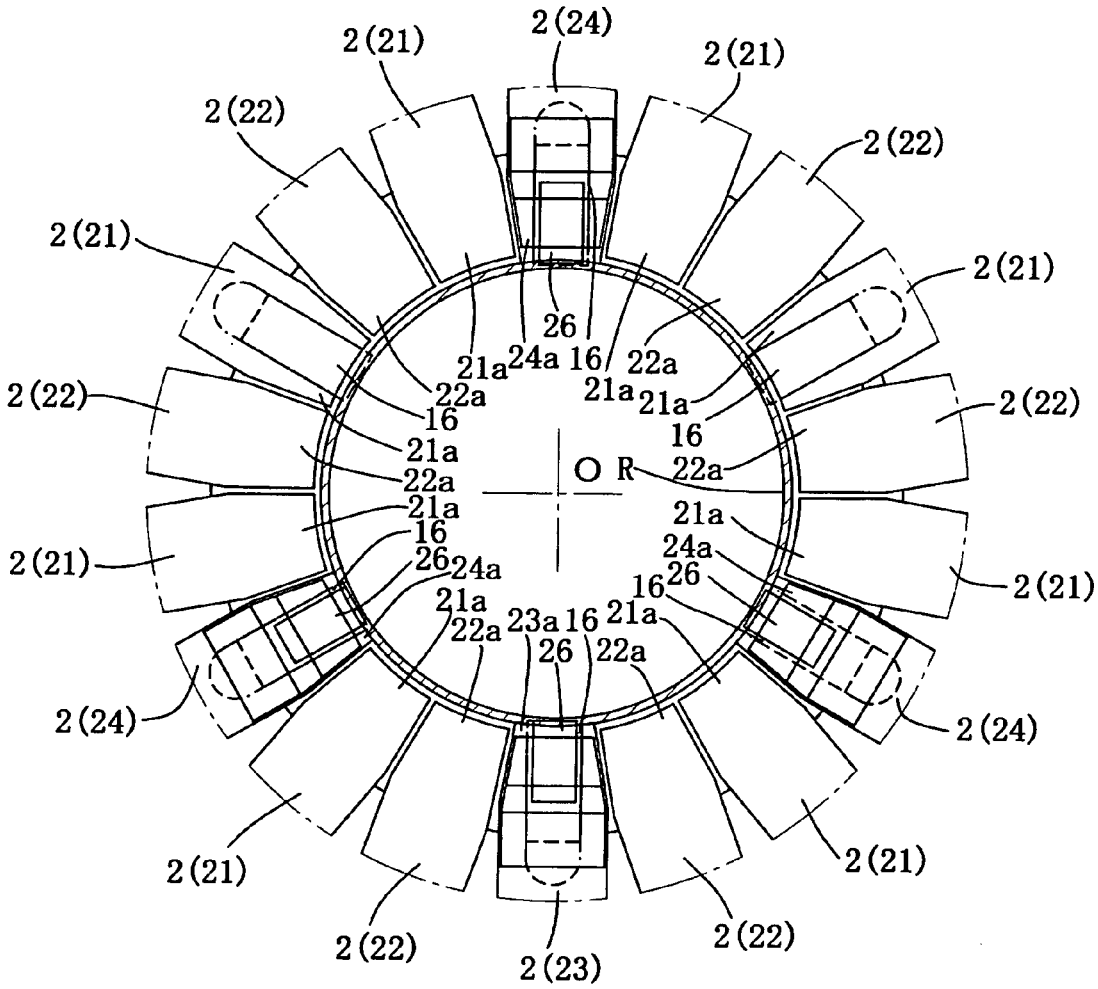
FIG. 8 is a front view of an initial state in which a ring is set in the pressing members.
Figure 9:
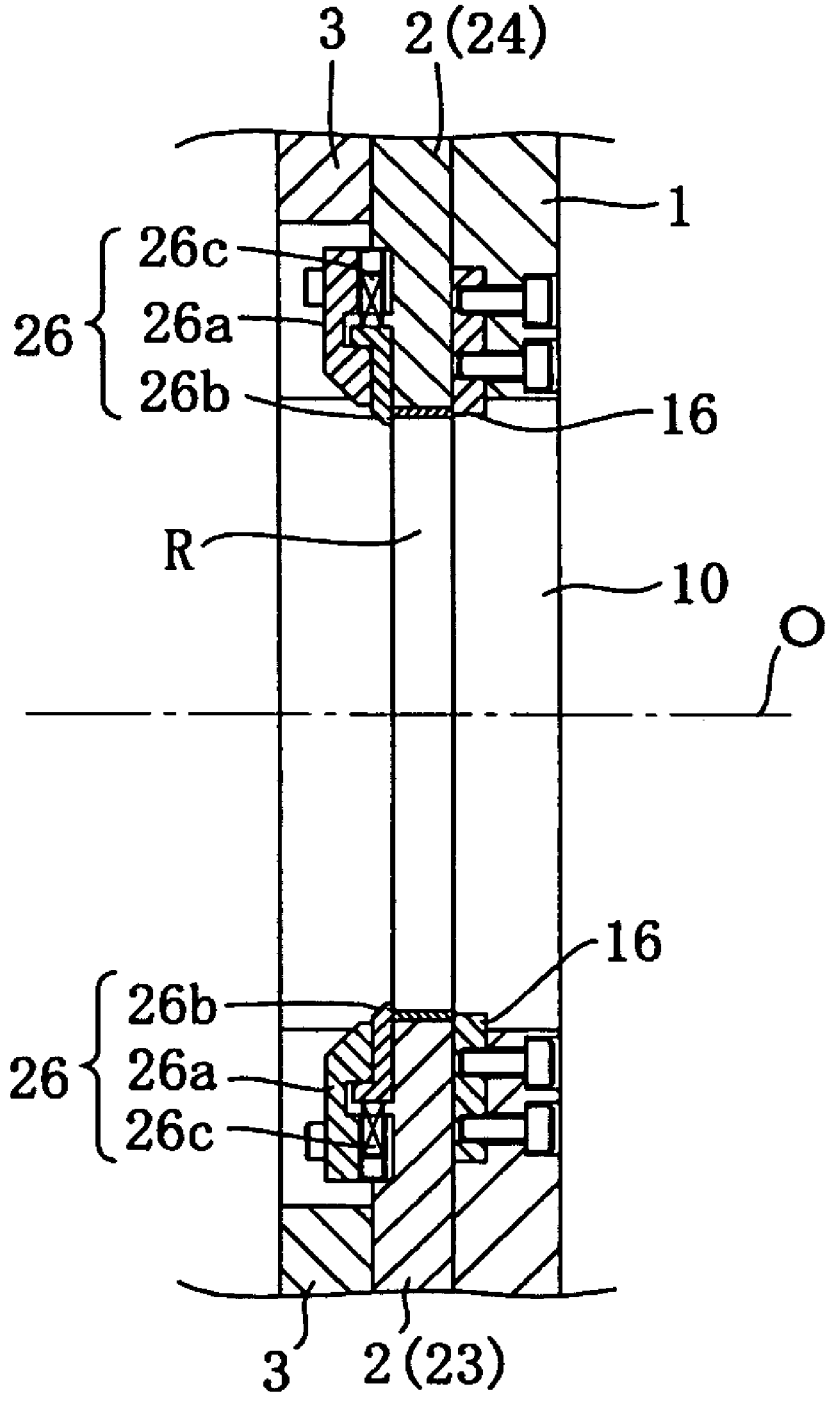
FIG. 9 is a side cross-sectional view of a state in which the ring is mounted in the ring compression device.
Figure 10:
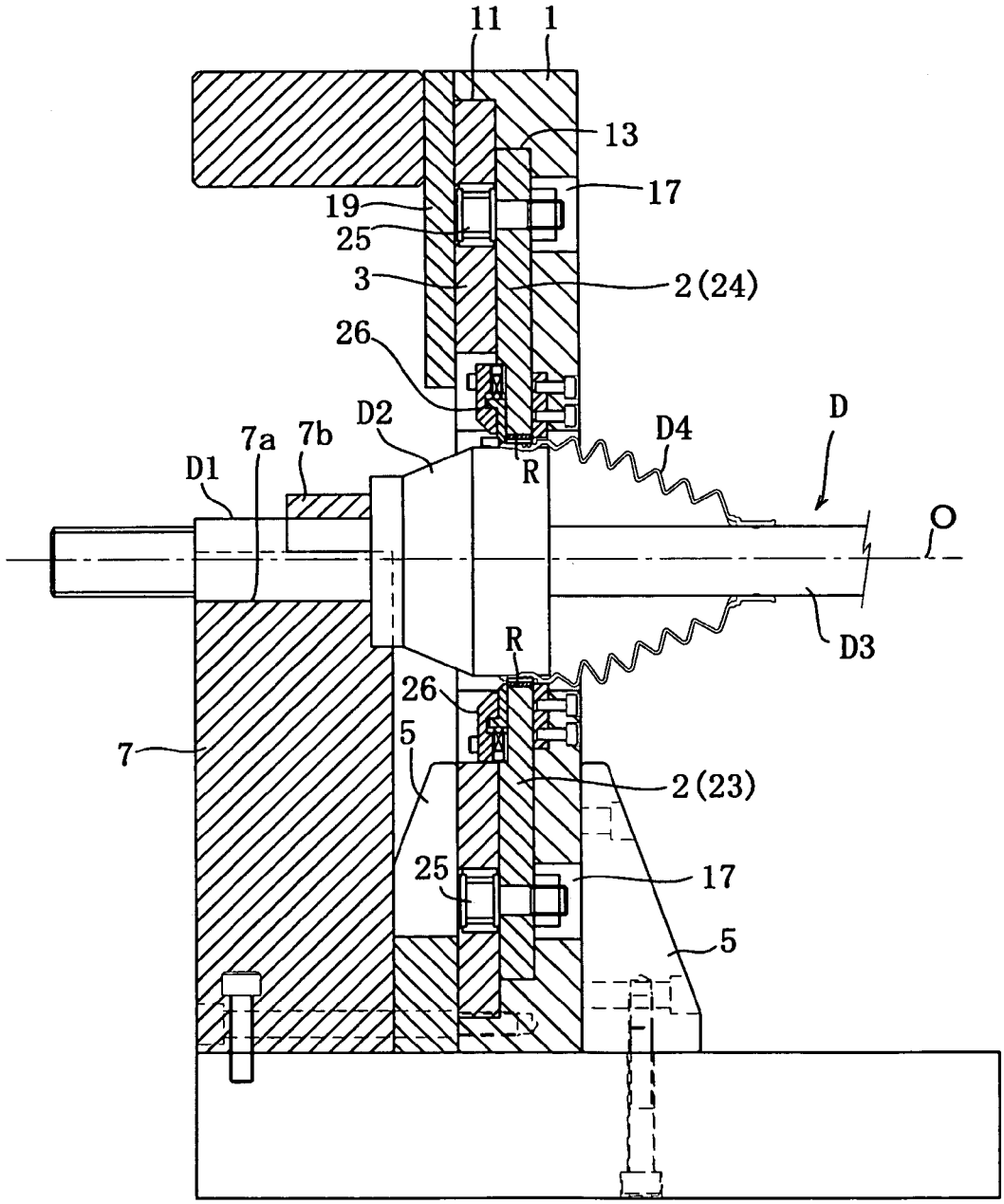
FIG. 10 is a side cross-sectional view of a state in which a mounting body is set inside the ring.
Figure 11:
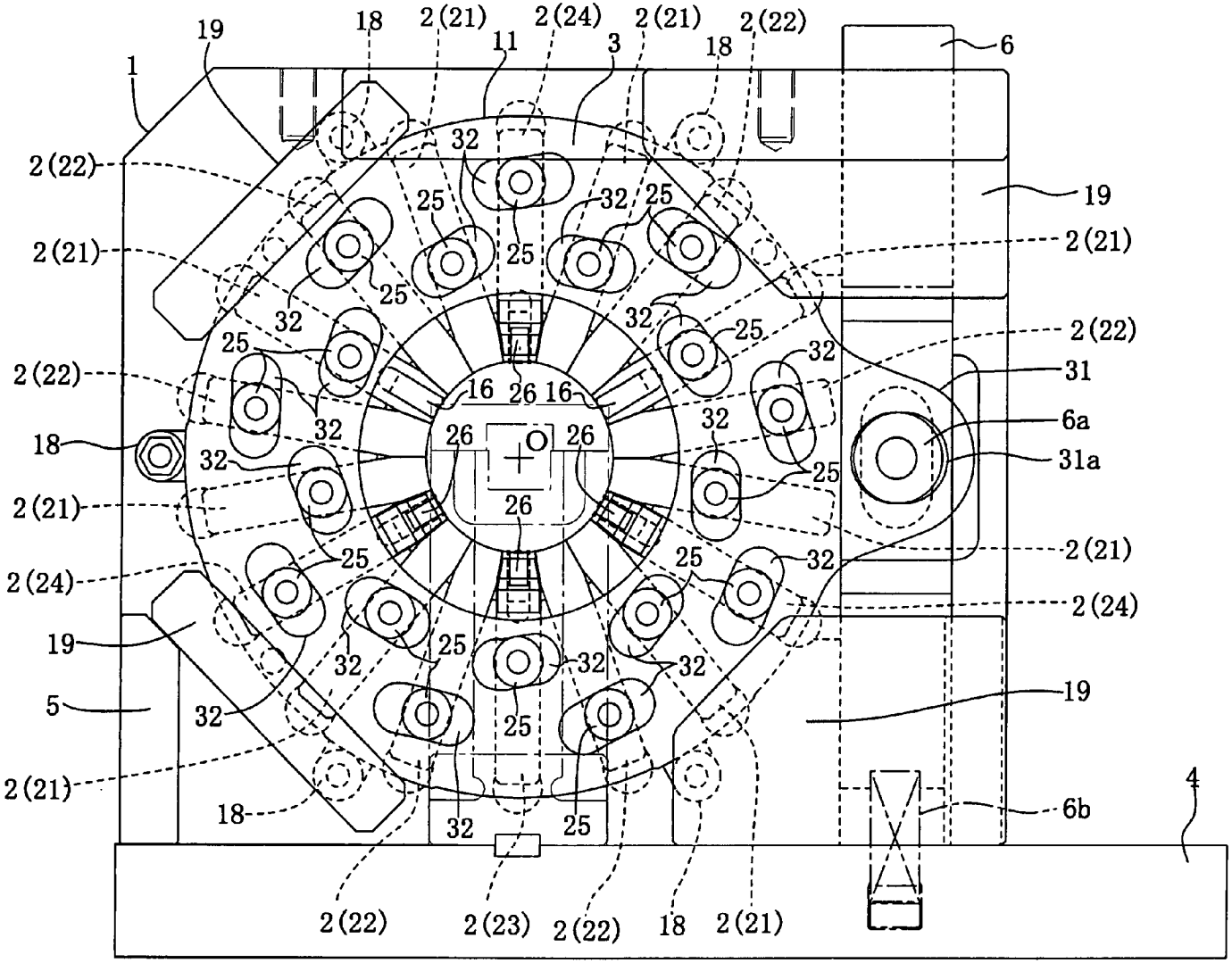
FIG. 11 is a front view for explaining the operations of the ring compression device.
Figure 12:
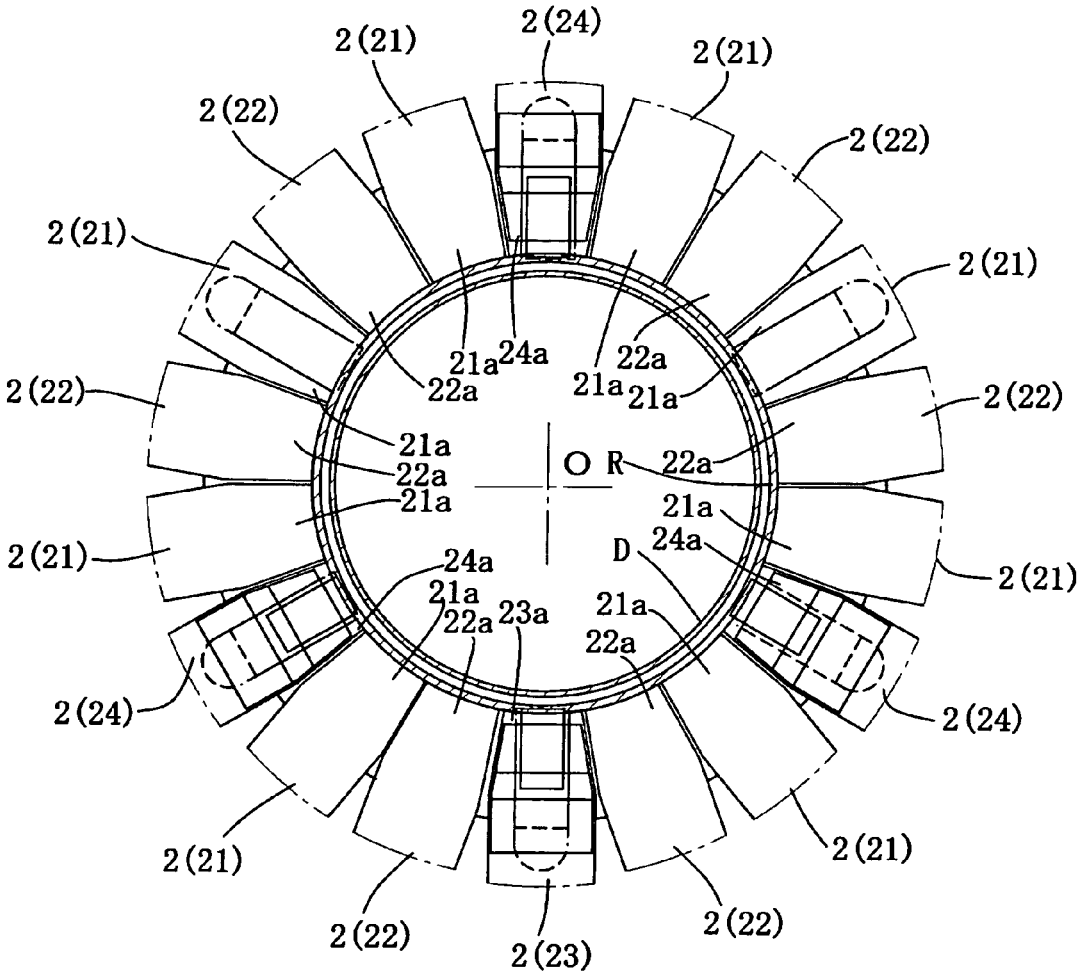
FIG. 12 is a front view for explaining compression of the ring.
Figure 13:
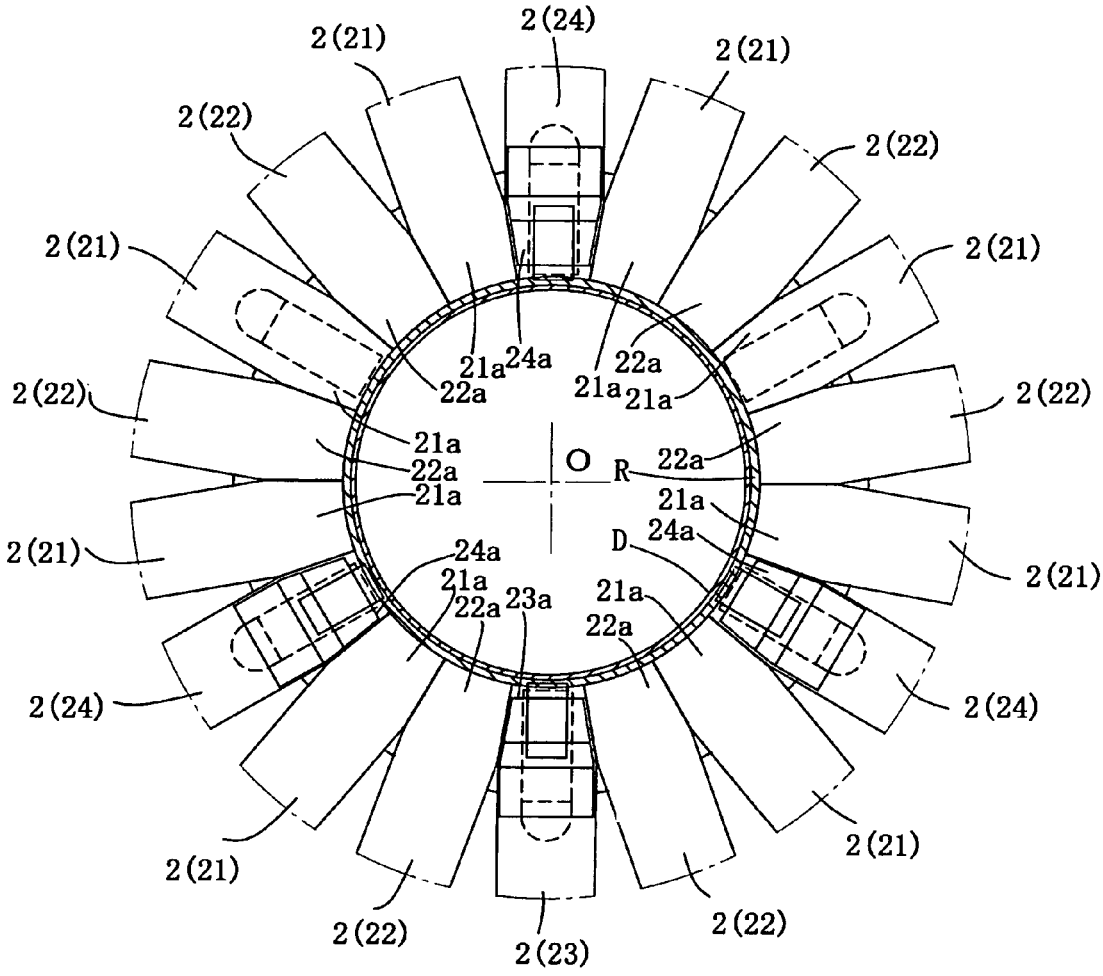
FIG. 13 is a front view for explaining compression of the ring.

FIG. 8 is a front view of a state in which a ring is mounted in a pressing member in the initial state; FIG. 9 is a side cross-sectional view of a state in which the ring is mounted; FIG. 10 is a side cross-sectional view of a state in which a mounting body is set inside the ring; FIG. 11 is a front view for explaining the operations of the ring compression device as a whole; FIG. 12 and FIG. 13 are front views of a state in which the ring is compressed.

At first, the device is set in an initial state. In the initial state, as shown in FIG. 1, the push rod 6 is raised upward by the compression spring 6*b*, and also the arm section 31 of the rotational body 3 engaged with the push rod 6 is upraised. Moreover, the pressing members 2 (21, 22, 23, 24) are at positions where the tips 21*a*, 22*a*, 23*a*, and 24*a* are retracted from the central axis O because of a form of the cam holes 32 of the rotational body 3 in which the cam followers are engaged respectively as described below in detail. In other words, as shown in FIG. 8, the tips 21*a*, 22*a* of the first pressing member 21 and the second pressing member 22 are further retracted from the central axis O as compared to the tips 23*a*, 24*a* of the third pressing member 23 and the fourth pressing member 24. To describe in further detail, when the pressing members 2 are retracted, positions of the tips 23*a* and 24*a* of the third pressing members 23 and the fourth pressing member 24 each as particular pressing members are on a reference circle around the central axis O, and positions of the tips 21*a*, 22*a* of the first pressing member 21 and the second pressing member 22 as other pressing members are off outward from the reference circle. This reference circle corresponds to an external periphery of the ring R around the central axis O.

Then, the ring R is mounted on the device. The ring R is inserted into an area surrounded by the tips 21*a*, 22*a*, 23*a*, and 24*a* of the pressing members 2 (21, 22, 23, and 24) from the front side of the device. The ring R inserted as shown in FIG. 9 once retracts and overrides the movable sections 26*b* of the movable claw sections 26 provided in the third pressing member 23 and the fourth pressing member 24 and contact the claw members 16. Then movable section 26*b* is restored to the original form by the compression spring 26*c*, and the ring R is hooked at the tips 23*a*, 24*a* arranged in the circular form between the movable sections 26*b* and the claw members 16. As a result, the ring R is mounted at the positions of the tips 23*a*, 24*a* of the third pressing member 23 and the fourth pressing member 24.

When the ring R is set as described above, if the ring R has an external periphery close to a perfect circle, the ring R is positioned and hooked by the tips 23*a*, 24*a* of the third pressing member 23 and the fourth pressing member 24 at a position around the central axis O as a center. Sometimes the external periphery of the ring R may deform. In this device, positions of the tips 21*a*, 22*a* of the first pressing member 21 and the second pressing member 22 are off outward from the reference circle as described above. Therefore, a portion of the ring R deformed outward is compensated by the positions of the tips 21*a*, 22*a* of the first pressing member 21 and the second pressing member 22. As a result, even when the ring R is deformed, the ring R can be set without causing any trouble, so that the ring R can smoothly be set.

After the ring R is set, the mounting body D is set in the device in the initial state. The mounting body D is inserted into the ring R already set within an area surrounded by the tips 21*a*, 22*a*, 23*a*, and 24*a* of the pressing members 2 (21, 22, 23, 24) from a rear surface of the device. The mounting body D inserted into the ring R as shown in FIG. 10 is held by the holding unit 7. With this operation, positions on the mounting body D where the ring R is to be set are aligned to the position of ring R previously set in the device, thus the mounting body D being positioned.

Then the push rob 6 is pushed in as shown in FIG. 11. As a result, the arm section 31 of the rotational body 3 engaged with the push rod 6 is pushed down, and the rotational body 3 rotates counterclockwise around the central axis O in FIG. 11. In this state, the tips 21*a*, 22*a*, 23*a*, and 24*a* of the pressing members 2 (21; 22, 23, and 24) are at positions forwarded toward the central axis O because of a form of the cam holes 32 on the rotational body 3 with which the cam followers 25 engage. As a result, force is applied to the ring R by the tips 21*a*, 22*a*, 23*a*, and 24*a* from the outside thereof so that the ring R is compressed, thus the ring R being set on the mounting body D.

When the ring R is compressed, the pressing members 2 (21, 22, 23, 24) move as described below. Namely, When the rotational body 3 starts rotation from the default state, only the tips 21*a*, 22*a* of the first pressing member 21 and the second pressing member 22 at positions off outward from the reference circuit as shown in FIG. 12 move forward toward the central axis O because of forms of the cam holes 32 on the rotational body 3 in which the cam followers 25 of the first pressing member 21 and the second pressing member 22 are engaged. The first pressing member 21 and the second pressing member 22 move until the tips 21*a*, 22*a* reach the reference circuit on which the tips 23*a*, 24*a* of the third pressing member 23 and the fourth pressing member 24 are present.

When the tips 21*a*, 22*a*, 23*a*, and 24*a* of all pressing members 2 (21, 22, 23, 24) are positioned on the reference circuit, if the ring R is deformed when set as described above, the deformation of the ring R is corrected by the tips 21*a*, 22*a* of the first pressing member 21 and the second pressing member 22 having moved thereto to the perfect circle.

When the rotational body 3 further rotates from the state shown in FIG. 12, the tips 21*a*, 22*a*, 23*a*, and 24*a* of all pressing members 2 (21, 22, 23, 24) move forward toward the central axis O because of the shapes of the cam holes 32 of the rotational body 3 in which the cam followers 25 are engaged as shown in FIG. 13. Because of this configuration, force is applied on the ring R by the tips 21*a*, 22*a*, 23*a*, and 24*a* by applying a force from the outside of the ring R, and the ring R is compressed. In this case, the force applied to the ring R is homogeneous around the central axis O, so that the uniformly compressed ring R is mounted on the mounting body D previously set and held around the central axis O.

In the state shown in FIG. 13 in which the ring R has been set on the mounting body D, the tips 21*a*, 22*a*, 23*a*, and 24*a* of all pressing members 2 (21, 22, 23, 24) are positioned along the external periphery of the ring R. Namely, the tips 21*a*, 22*a*, 23*a*, and 24*a* each having a curved form are positioned along the external periphery of the compressed ring R divided by the pressing members 2 (21, 22, 23, 24).

Thus, the ring compression device has the single rotational body 3 that moves forward the tips 21*a*, 22*a*, 23*a*, and 24*a* of all pressing members 2 (21, 22, 23, 24) toward the central axis O, and the pressing members 2 (21, 22, 23, 24) are integrally engaged therein. Because of such a configuration, there is only one delivery system for delivering operations of the single rotational body 3 to the pressing members 2 (21, 22, 23, 24). As a result, the pressing members 2 can move uniformly, so that a uniform force can be applied to the ring R.

In the initial state of the device for setting the ring R onto the tips 21*a*, 22*a*, 23*a*, and 24*a* of all pressing members 2 (21, 22, 23, 24), the tips 23*a*, 24*a* of the third pressing member 23 and the fourth pressing member 24 are on the reference circle (external periphery of the ring R) around the central axis O, while the tips 21*a*, 22*a* of the first pressing member 21 and the second pressing member 22 are off outward from the reference circle. Moreover, a hooking unit including the claw member 16 and the movable claw section 26 is provided for the tips 23*a*, 24*a* of the third pressing member 23 and the fourth pressing member 24. Because of such a configuration, when the ring R is perfectly circular, the ring R can be supported by the hooking unit around the central axis O. When the ring R is deformed, the deformation is taken care of because of the positions of the tips 21*a*, 22*a* of the first pressing member 21 and the second pressing member 22, so that the ring R can firmly be supported by the hooking unit. As a result, the ring R can be mounted easily without any deformation.

The driven unit including the cam followers 25 and the cam holes 32 for moving the pressing members 2 move the tips 21*a*, 22*a* of the first pressing member 21 and the second pressing member 22 because of the forms of the cam holes 32 up to positions on a reference circle. Because of such a configuration, when the ring R is deformed, the form of the ring R can be corrected to a perfect circle based on the reference circle.

Furthermore, by holding the mounting body D with the holding unit 7 provided on the base plate 4, the positions on the mounting body D at which the ring R is to be set can be aligned in relation to the position of the ring R previously set on the device.

Furthermore, the ring compression method based on operations of the ring compression device described above comprises the steps of hooking the ring R inside the tips 21*a*, 22*a*, 23*a*, and 24*a* of all pressing members 2 (21, 22, 23, 24); inserting and holding a mounting body D within the ring R; and applying force to the ring R with the tips 21*a*, 22*a*, 23*a*, and 24*a* moved forward from outside of the ring R. Because of this functional configuration, a clearance between the ring R and the mounting body D before the ring R is set on the mounting body D is accommodated, so that positioning to each other can accurately be carried out for holding. As a result, force to the ring R can be stabilized, and force toward a center of the mounting body D can be stabilized, so that the ring R can be set smoothly and easily on the mounting body D.

The ring compression method further includes the step of aligning positions of the tips 23*a*, 24*a* with the reference circle corresponding to the external periphery of the ring R around the central axis O and arranging the other tips 21*a*, 22*a* at positions off outward from the reference circle before the ring R is hooked. Because of such a configuration, when the ring R perfectly circular, the ring R can be supported at accurate positions around the central axis O by the tips 23*a*, 24*a*. When the ring R is deformed, the deformation is accommodated because of the positions of the tips 21*a*, 22*a*.

The ring compression method further includes the step of aligning positions of all tips 21*a*, 22*a*, 23*a*, and 24*a* to the reference circle in the step of moving forward the tips 21*a*, 22*a*, 23*a*, and 24*a*. As a result, when the ring R is in deformed state even before the mounting, the deformation can be eliminated with the form of ring R corrected to a perfect circle.

In the embodiment, the ring R is set along an external periphery of each opening of the boot D4 over the joint section D2 for the constant velocity as the mounting body D. Although not shown in the figure, when the ring R is set along an external periphery of each opening of the boot D4 over the other shaft D3 of the constant velocity joint, the configuration as described above may be employed, and in this case, it is required to elongate the tips 21*a*, 22*a*, 23*a*, and 24*a* of the pressing members 2 (21, 22, 23, 24) toward the central axis O and to align the ring R with the external periphery of each opening of the boot D4 over the other shaft D3. As a result, the holding unit 7 changes the position so that the external periphery of each opening of the boot D4 over the other axis D3 is positioned in an inner side from the tips 21*a*, 22*a*, 23*a*, and 24*a* of the pressing members 2 (21, 22, 23, 24).

INDUSTRIAL APPLICABILITY

As described above, the ring compression device and ring compression method according to the present invention are useful for applying force to a ring from outside of the ring to mount the ring on a mounting body inside the bore of the ring, and is especially adapted to positioning the ring and the mounting body by applying a uniform force from an outer periphery of the ring.

The invention claimed is:

1. A ring compression device that applies force on a periphery of a ring to thereby compress the ring and fix the ring on a mounting body placed inside the ring, comprising:

a non-rotatable substrate having a central axis;

a plurality of longitudinal pressing members arranged on a first plane different from that of the substrate and radially around the central axis, each of said pressing members having one end pointing toward the central axis, the pressing members capable of freely moving toward or away from the central axis in the first plane;

a rotating body configured to rotate around the central axis in second plane that is parallel to the first plane; and a driving mechanism having cam followers respectively provided on the pressing members and cam holes formed in the rotating body and respectively engaged with the cam followers, the driving mechanism being configured to integrally move, along with the rotation of the rotating body in one direction, all of the pressing members toward the central axis and apply force on the periphery of the ring with the one end of each of the pressing members; and a hooking mechanism that hooks the ring, the hooking mechanism having a claw member abutting on an edge face on one side of the ring on the side of the substrate and also having a movable claw member abutting on an edge face on the other side of the ring on the tip side of the specific pressing member, wherein the a tip of at least one of a first pressing member, at an initial position, is located on a circle around the central axis corresponding to the periphery of the ring, and tip ends of a plurality of second pressing members, at an initial position, are located outside of the circle, and the cam holes are configured to move the tip ends of the second pressing members toward the circle, and to move, once the tip ends of each of the second pressing members are located on the circle, all of the tip ends of the pressing members toward the central axis.

2. The ring compression device according to claim 1, wherein, in an initial state, the one end of at least one of the pressing members is located on a circle with the central axis as a center and diameter of the ring as a diameter, and the one end of each of the other pressing members is located outside of the circle, wherein the driving mechanism engages with the rotating body and the pressing members such that, when the rotating body rotates, the one end of each of the other pressing members moves toward the circle, and once the one end of the other pressing members is located on the circle, all the pressing members move towards the central axis.

3. The ring compression device according to claim 1, further comprising a holding mechanism configured to hold the mounting body in such a manner that the mounting body is aligned to the central axis.

4. The ring compression device according to claim 1, further comprising a holding mechanism configured to hold the mounting body in such a manner that the mounting body is aligned to the central axis, wherein, in an initial state, that one end of at least one of the pressing members is located on a circle with the central axis as a center and diameter of the ring as a diameter, and the one end of each of the other pressing members is located outside of the circle, wherein the driving mechanism engages with the rotating body and the pressing members such that, when the rotating body rotates, the one end of each of the other pressing members moves toward the circle, and once the one end of each of the other pressing members is located on the circle, all the pressing members move toward the central axis.

5. The ring compression device according to claim 1, further comprising:

a hooking mechanism that hooks the ring, the hooking mechanism having a claw member abutting on an edge face on one side of the ring on the side of the substrate and also having a movable claw member abutting on an edge face on the other side of the ring on the tip side of the specific pressing member, wherein, in an initial state, the one end of at least one of the pressing members is located on a circle with the central axis as a center and diameter of the ring as a diameter, and the one end of each of the other pressing members is located outside of the circle, wherein the driving mechanism engages with the rotating body and the pressing members such that, when the rotating body rotates the one end of each of the other pressing moves toward the circle, and once the one end of each of the other pressing members is located on the circle, all the pressing members move toward the central axis; and a holding mechanism configured to hold the mounting body in such a manner that the mounting body is aligned to the central axis.

6. The ring compression device according to claim 1, wherein the cam holes are configured to move the tip end of the second pressing member toward the circle while maintaining the tip end of the first pressing member on the circle, and to move, once the tip end of each of the second pressing member is located on the circle, the first and second tip ends toward the central axis.

7. A ring compression method of applying force on a ring to fix the ring on a mounting body, comprising:

hooking the ring with one end of each of a plurality of longitudinal pressing members that can freely move in a first plane and in a radial direction with respect to an axis;

inserting the mounting body into a bore of the ring and holding the body in such a manner that the mounting body is aligned with the axis; and forcibly moving the one end of each of the pressing members towards the axis by rotating in one direction a rotational body arranged in a second plane that is parallel to the first plane to act on the pressing members to thereby apply force on the ring, the rotational body having a plurality of cam holes in the second plane, the pressing members respectively having cam followers that engage with the cam holes, wherein the hooking includes hooking the ring between a claw member abutting on an edge face on one side of the ring on the side of the substrate and also having a movable claw member abutting on an edge face on the other side of the ring on the tip side of the specific pressing member, and, wherein a tip end of at least a first pressing member, at an initial position, is located on a circle around the central axis corresponding to the periphery of the ring, and tip ends of a plurality of second pressing members, at an initial position, are located outside of the circle, and wherein the cam holes are configured to move the tip ends of the second pressing members toward the circle, and to move, once the tip ends of the second pressing member are located on the circle, all of the tip ends of the pressing members toward the central axis.

8. The ring compression method according to claim 7, further comprising:

first controlling, before the hooking, such that the one end of at least one of the pressing members is located on a circle with the axis as a center and diameter of the ring as a diameter, and the one end of each of the other pressing members is located outside of the circle; and second controlling, before the hooking and after the first controlling, such that the one end of each of the other pressing members move moves toward the circle, and once the one end of each of the other pressing members is located on the circle, all the pressing members move toward the central axis.

* * * * *